United States Patent [19]

Wood, Jr.

[11] 4,132,022

[45] Jan. 2, 1979

[54] REFLECTED SIGN

[76] Inventor: Charles P. Wood, Jr., 1020 Richwood, Cincinnati, Ohio 45226

[21] Appl. No.: 740,479

[22] Filed: Nov. 10, 1976

[51] Int. Cl.[2] ..... G09F 7/00

[52] U.S. Cl. ..... 40/591; 40/5; 40/530

[58] Field of Search ..... 40/129 C, 130 B, 102, 40/5, 591

[56] References Cited

U.S. PATENT DOCUMENTS

| | | | |
|---|---|---|---|
| 1,346,017 | 6/1920 | Goodman | 35/9 H |
| 2,517,963 | 8/1950 | Bausch | 40/130 B |
| 3,168,070 | 2/1965 | Verney | 40/129 C X |
| 3,455,044 | 7/1969 | Falconbridge | 40/129 C X |
| 3,481,060 | 12/1969 | Hartz | 40/102 |
| 3,531,880 | 10/1970 | Ramee | 40/129 C |

FOREIGN PATENT DOCUMENTS

| | | | |
|---|---|---|---|
| 562607 | 11/1923 | France | 40/130 B |
| 37298 | 11/1930 | France | 40/130 B |

*Primary Examiner*—Louis G. Mancene
*Assistant Examiner*—Wenceslao J. Contreras
*Attorney, Agent, or Firm*—Wood, Herron & Evans

[57] ABSTRACT

A reminder device adapted to be carried on a vehicle's dashboard in front of the vehicle's steering mechanism in such a position as to reflect upwardly onto the inside of the windshield at a position where same can be viewed and read by the driver. The reminder device includes structure movable between a reminder position in which a message reverse-printed on the structure is readable in the windshield as reflected, and a storage position in which the message reverse-printed on the structure is not readable.

2 Claims, 4 Drawing Figures

REFLECTED SIGN

This invention relates to reminder devices.

As has been expressed in literature over the years, the American public and the automobile have had a love affair since the invention of the horseless carriage. In recent times, greater numbers of automobiles are on the nation's highways than ever before. One problem which faces every automobile driver is the necessity of maintaining sufficient gasoline in the automobile's fuel tank so as to prevent running out, i.e., to prevent the automobile from stopping, in an undesired location. In order to aid the driver in determining when gasoline in the fuel tank is low, most automobile manufacturers today include a fuel gauge on the automobile's dashboard. The fuel gauge is positioned generally in front of the driver position within the car, and is positioned on that portion of the dashboard which is generally vertically and forwardly of the automobile's steering wheel. In this position, it is necessary for the automobile driver to periodically remove his eyes from the road to glance down at the fuel gauge in order to determine the gasoline level in the fuel tank. In other words, the fuel gauge is in the nature of a reminder device which functions to remind the automobile driver, whenever that fuel gauge is reviewed by the driver's eyes, as to the current quantity of gasoline remaining in the fuel tank. The periodic review required becomes particularly bothersome for the driver as the fuel gauge indicates that the gasoline level in the fuel tank is shrinking to increasingly lower levels. It is in a low level fuel situation that the driver may absentmindedly forget to check his fuel gauge again until it is too late, i.e., until the tank has run dry, or that the tank may run dry prior to the driver being able to reach a fuel station (particularly as may occur in nonpopulated areas of the country).

Thus, it has been the primary objective of this invention to provide a reminder device adapted to be carried on a vehicle's dashboard in front of the vehicle's steering mechanism in such a position as to reflect upwardly onto the inside of the windshield at a position where same can be viewed and read by the driver, the reminder device including structure movable between a reminder position in which a message reverse-printed on the structure is readable in the windshield as reflected, and a storage position in which the message reverse-printed on the structure is not readable.

Other objectives and advantages of this invention will be more apparent from the following detailed description taken in conjunction with the drawings in which.

Figure 1:
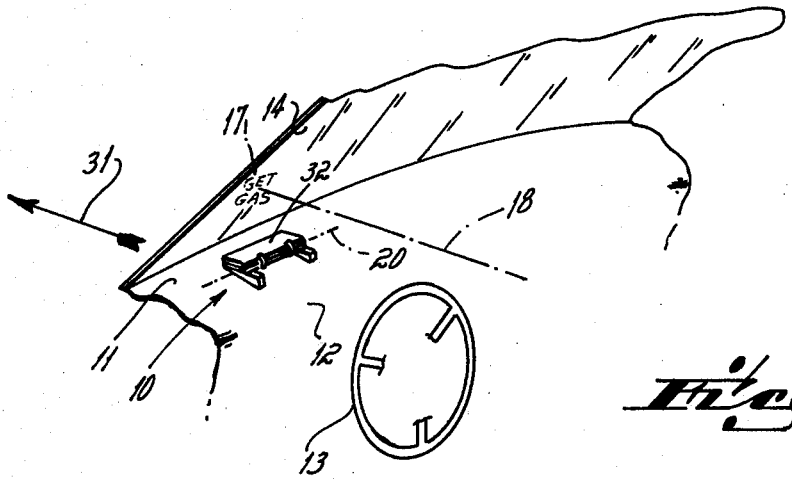
FIG. 1 is a perspective view of a reminder device in accord with the principles of this invention, that reminder device being mounted on the top surface of an automobile dashboard.

The reminder device 10 of this invention is particularly adapted for use with an automobile that is gasoline powered. As illustrated in FIG. 1, the reminder device

10, when used in connection with an automobile, is preferably mounted on the horizontal or top surface 11 of the automobile's dashboard 12 between the automobile's steering wheel 13 and the windshield 14 but toward the center of the automobile. The reminder device 10 is thereby located in front of, but slightly to the right side of, the driver of the automobile.

Figure 2:
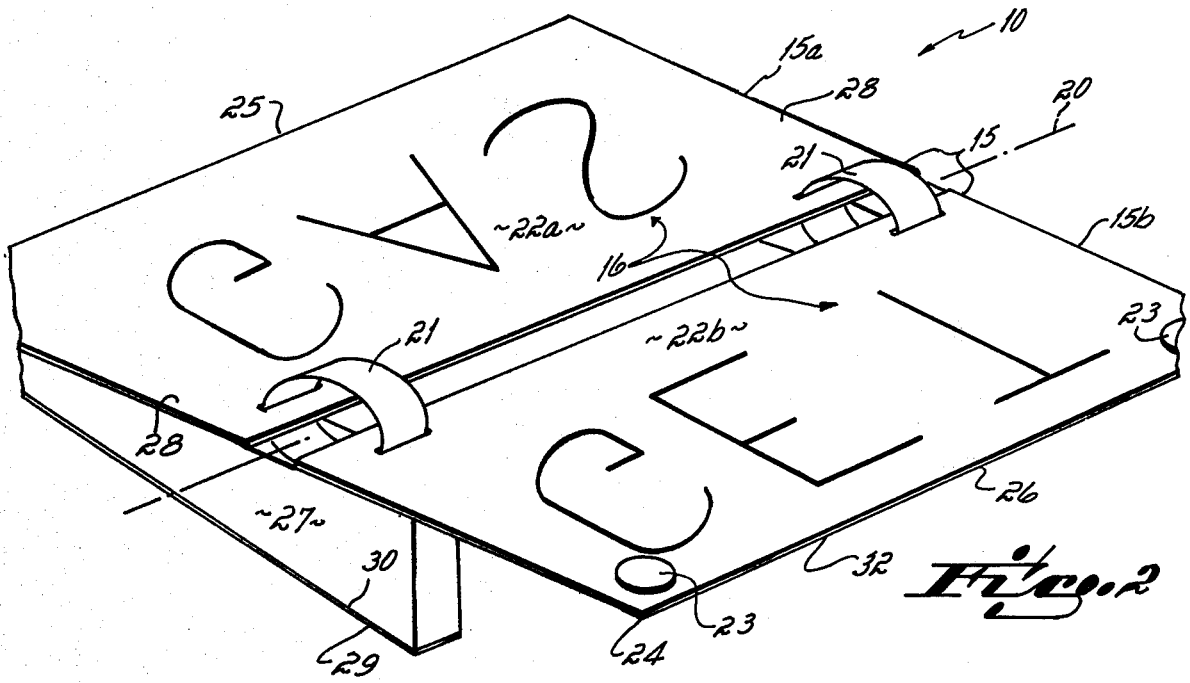
FIG. 2 is a blown-up perspective view illustrating the structural components of that reminder device illustrated in FIG. 1.

That embodiment of the reminder device illustrated in FIGS. 1 and 2 is in the nature of a placard *15a, 15b* structure having the reminder message 16 reverse-printed thereon. The reminder device 10 is structured so as to be movable between a reminder position in which the reminder message 16 is constantly readable by the driver (see solid line position of FIG. 1 and FIG. 2), and a storage position in which the message is not readable (see phantom line position of FIG. 1 and FIG. 2). In the readable position, the message 16 on the placard 15 structure is reflected up onto the inside of the vehicle's windshield 14, the placard structure being preferably positioned and mounted on the dashboard 12 in the first instance so that the position of the reflected message 17 on the windshield is generally within the line of sight 18 of the driver, but slightly off to the right side of the driver so that the driver's vision of the road is not obscured. The message 16 is reflected in readable form because of the reverse-printing of same on the placard 15 structure. The message 16 is not readable in the storage position because the placard 15 structure is fabricated such that the message cannot be reflected up onto the inside of the vehicle's windshield 14 when the placard structure is in that storage position.

One embodiment of a placard 15 structure is illustrated in greater detail in FIG. 2. As shown in that Figure, the placard 15 structure includes a bottom placard leaf *15a* and a top placard leaf *15b*, the two leaves being pivotally connected one to another along hinge axis 20 by means of spaced rings 21. Note that the pivot axis 20 of the placard leaves *15a, 15b* is positioned transverse to the driver's line of sight 18 when the placard structure is mounted on the vehicle's windshield, as illustrated in FIG. 1. Note also that the reminder message 16, i.e., GET GAS as illustrated, is reverse-printed on the interior or overlying faces *22a, 22b* of the placard leaves 15 when those leaves are in the storage position. More specifically, the fixed or nonmovable placard leaf *15a* is reverse-printed with the word GAS and the pivotable or removable placard leaf *15b* is reverse-printed with the word GET.

As illustrated in FIG. 2, note that the placard 15 structure is provided with spacer tabs 23 disposed in each free edge corner 24 of the pivotable placard leaf *15b*. The spacer tabs 23 permit a limited space to be retained between the leading edge 25 of the nonmovable leaf *15a* and the leading edge 26 of the pivotable leaf *15b* when same are in the folded or storage attitude so that same can be easily separated by the driver upon desire to use the device 10. Note also, as illustrated in FIG. 2, that the placard 15 structure is mounted on a wedge 27 at each side edge 28 thereof. The nonmovable placard leaf *15a* of the placard 15 structure is, in effect, carried on the wedges which, in turn, are mounted to the horizontal dashboard surface 11 by double faced adhesive tape strips 29 fixed to the bottom surfaces 30 of the wedges 27. The wedges 27 permit the GET GAS legend to be angled at a desirable attitude relative to the sloping windshield 14 so that the reminder message 16 can be adequately reflected, as in phantom at 17 in FIG. 1, in the desired position vis-a-vis the line of sight 18 of the driver when the placard 15 structure is opened into the reminder position, i.e., the readable attitude, illustrated in FIG. 2.

In use, the placard 15 structure is mounted on the vehicle's dashboard 11 so that the free edges 25, 26 of the placard leaves 15*a*, 15*b* lead the pivot axis 20 of those leaves relative to the automobile's travel direction (see directional arrow 31). Thus, and when the placard 15*a*, 15*b* structure is flipped to the readable reminder position, the reverse-printed words GET GAS are reflected up into the windshield 14 to permit reading thereof from left to right and top to bottom in accord with normal reading practice. In other words, and for example, when the gasoline level in the automobile's fuel tank (not shown) starts to register toward the low end of the fuel gauge (not shown) on the dashboard, the placard 15 structure is moved by the driver between the storage attitude and the reminder or readable attitude so as to present the reminder message 16 of GET GAS to the driver until that errand has been accomplished. The reminder message 16 is presented simply by pivoting the movable placard leaf 15*b* back onto the top surface of wedges 27 in that attitude illustrated in FIG. 2 so that the message GET GAS is reflected onto the inside of the windshield 14 in the general line of sight 18 of the driver. The legend GET GAS, or other suitable reminder message, is imprinted on the placard 15 structure in a readily reflective substance, e.g., a reflective ink, so that the message is, indeed, reflected up into the windshield 14 either by sunlight (during daylight hours) or by headlights of oncoming cars (in nighttime hours).

When the reminder device 10 is to be disposed in the storage position, the movable placard leaf 15*b* is simply positioned to overlie the fixed placard leaf 15*a*, thereby closing the GET GAS legend to view, see FIG. 1. Since the top surface 32 of the movable placard leaf 15*b* is provided with a generally nonreflective surface, e.g., a non-reflective ink, same is not reflected sufficiently in the windshield 14 to distract the driver when the device 10 is in the storage position.

Figure 3:
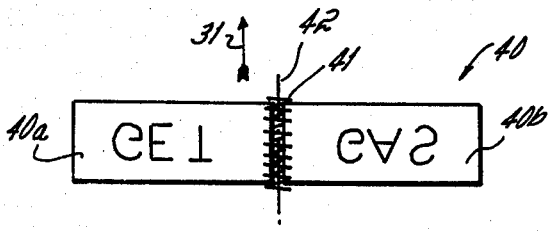
FIG. 3 is a top view illustrating a first alternative embodiment of a reminder device in accord with the principles of this invention.

A first alternative embodiment of the reminder device 10 structure is illustrated in FIG. 3. The first alternative embodiment also constitutes a placard 40 structure havng a fixed placard 40*a* and a pivotable placard 40*b*. Note particularly in this first alternative embodiment that the movable placard 40*b* is connected by rings 41 to the fixed placard 40*a* to define a hinge axis 42 which, when the placard 40 structure is mounted on the dashboard 12 of an automobile, is parallel to the travel direction (see directional arrow 31) of the automobile itself. This contrasts with the embodiment illustrated in FIGS. 1 and 2 which presents pivot axis 20 of the placard 15 structure in a position that is transverse to the travel direction 31 of the automobile when that placard structure is mounted on the automobile's dashboard 12. The reminder message GET GAS is the same in the first alternative embodiment shown in FIG. 3 as in that embodiment illustrated in FIGS. 1 and 2, and that message is shown with the word GET on the left hand or fixed placard leaf 40*a* and the word GAS on the right hand or pivotable placard leaf 40*b* so that the message reads normally from left to right when reflected on the windshield 14.

Figure 4:
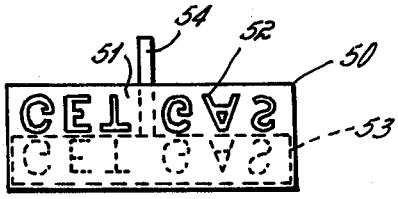
FIG. 4 is a top view illustrating a second alternative embodiment of a reminder device in accord with the principles of this invention.

A second alternative embodiment of the reminder device 10 is illustrated in FIG. 4. In that FIG. 4 embodiment, there is shown a placard structure including an outer envelope 50 adapted to be mounted on the dashboard 12 of the automobile. The outer envelope 50 is cut out as at 52 in the top wall 51 thereof with the GET GAS message. The outer envelope 50 receives an inner reflection board 53 which, when inserted entirely within the envelope 50 structure establishes the storage position and provides no reflective surface through the cut out 52 in the top wall 51 of the envelope. On the other hand, when the reflection board 53 is pulled to the reminder or reflective position by tab 54 fixed to that inner or reflection board, then the reflective ink message GET GAS appears through the cut out 52 GET GAS in the top wall 51 of the envelope 50 structure so that the reverse-printed message is readable in the windshield as reflected. As with the FIGS. 1 and 2, and with the FIG. 3, embodiment structures, this second alternative embodiment structure is mounted on the dashboard 12 in front of the driver so that the message is reflected upwardly onto the windshield 14 at a position on the windshield where same can be easily viewed and read by the driver.

Having described in detail my invention, what I desire to claim and protect by Letters Patent is:

1. A message reminder device for a driver of a vehicle, said device comprising a windshield and a dashboard, said windshield extending upwardly above said dashboard, a placard structure having a first placard component adapted to be mounted in a fixed position onto said dashboard and a second placard component movable relative to said first component, said two placard components being pivotable relative one to the other, one of said components including at least one spacer block mounted thereon to maintain a discrete distance between the components when same overlie one another in a storage position, and message indicia denoted in word form, and in reverse image form, on one side of at least one of said fixed and movable components, the mounted location of said placard structure on said dashboard permitting said message indicia to be reflected upwardly into said windshield for easy viewing and reading by the driver of that vehicle in which said device is mounted, said movable placard component being movable between a reminder position in which said message indicia can be reflected onto said windshield to present same in readable form, and a storage position in which said message is not reflected onto said windshield.

2. A reminder device as set forth in claim 1, said placard structure including at least one adhesive strip thereon for adhering said structure to a vehicle's dashboard.

* * * * *